United States Patent [19]

Clark

[11] Patent Number: 4,581,858

[45] Date of Patent: Apr. 15, 1986

[54] HUTCH DIVIDER

[76] Inventor: Bernyce A. Clark, 243 E. 32nd St., Apt. 608, Chicago, Ill. 60616

[21] Appl. No.: 661,103

[22] Filed: Oct. 15, 1984

[51] Int. Cl.[4] ..... E04B 2/82

[52] U.S. Cl. ..... 52/36; 52/37; 52/238.1; 52/204; 52/311; 312/209

[58] Field of Search ..... 52/238.1, 36, 204, 37, 52/205, 311; 312/101, 102, 209, 278

[56] References Cited

U.S. PATENT DOCUMENTS

| | | | |
|---|---|---|---|
| 959,230 | 5/1910 | Kurz | 312/209 |
| 1,521,521 | 12/1924 | Flagg | 52/238.1 |
| 2,027,491 | 1/1936 | Percy | 52/204 |
| 2,107,145 | 2/1938 | Davis | 52/238.1 |
| 2,830,331 | 4/1958 | Oakes | 52/204 |
| 2,878,667 | 3/1959 | Jones | 52/204 |
| 3,834,777 | 9/1974 | Swensson | 52/36 |
| 4,360,991 | 11/1982 | West | 52/36 |

*Primary Examiner*—John E. Murtagh

[57] ABSTRACT

This divider is designed to improve the decor of apartments that have divider walls for the partial separation of a kitchen and living room, etc. Primarily, it consists of a frame including a wall therein, with an opening that serves as a false window. It also includes shelves and curtains. It further includes a channel portion on the bottom for mounting the frame stationary to the divider wall existing in the dwelling.

1 Claim, 5 Drawing Figures

HUTCH DIVIDER

This invention relates to shelving devices, and more particularly, to a hutch divider.

The principal object of this invention is to provide a hutch divider, which will be of such design, that it will fit onto such divider walls as are commonly employed between living rooms, kitchens, etc.

Another object of this invention is to provide a hutch divider, which will include shelving and a false window therein, and curtains on one side, so as to be very decorative in appearance, as well as having utility value.

A further object of this invention is to provide a hutch divider, which will be further unique, in that no nails, screws, or other fasteners will be employed in its fabrication, thus enabling it to be removed at any time desired, without causing damage.

Other objects are to provide a hutch divider, which is simple in design, inexpensive to manufacture, rugged in construction, easy to use, and efficient in operation.

These, and other objects, will be readily evident, upon a study of the following specification, and the accompanying drawing, wherein.

Figure 1:
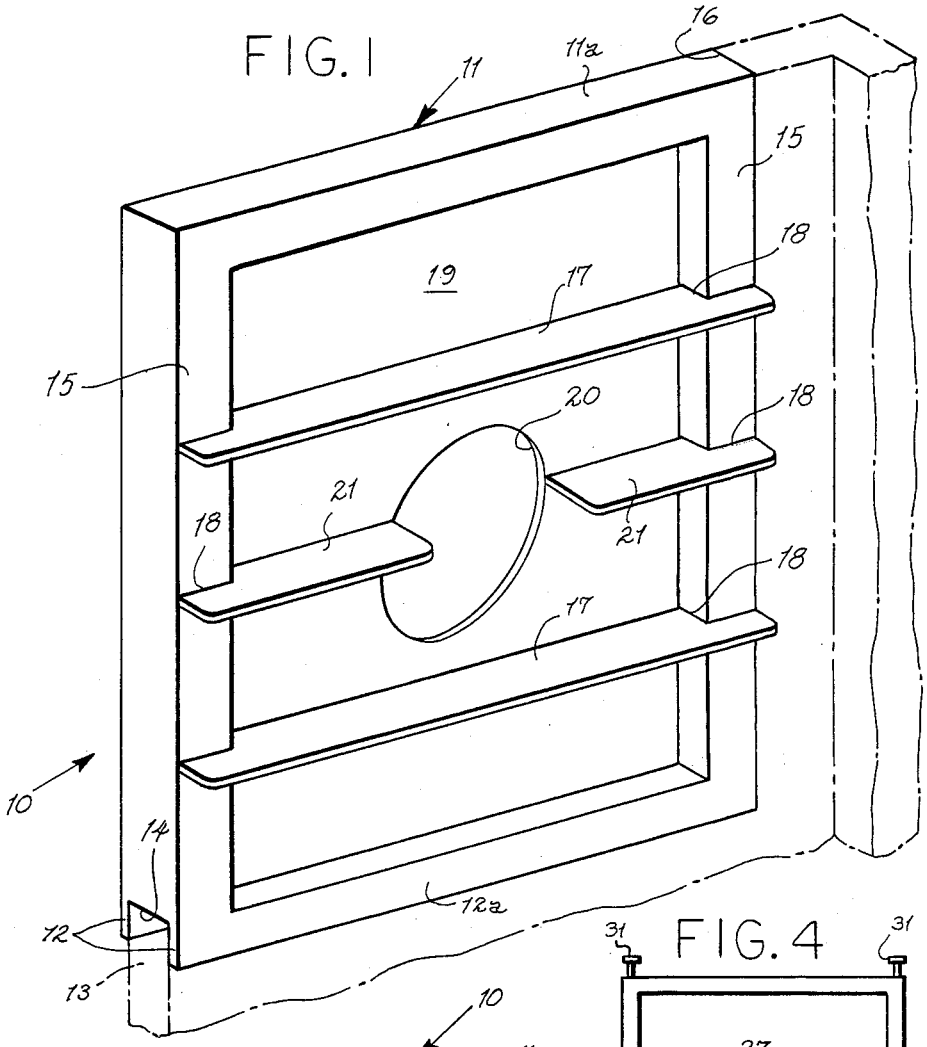
FIG. 1 is a perspective view of the present invention, shown mounted to a section of wall, which is illustrated in phantom lines.
Figure 2:
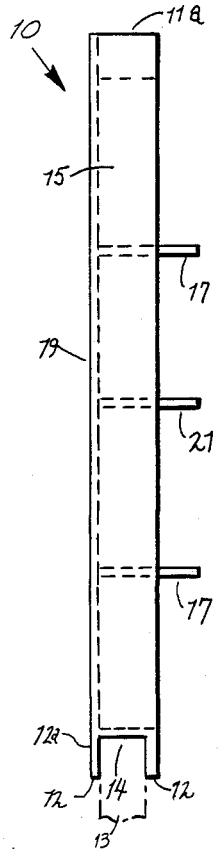
FIG. 2 is a side view of FIG. 1.
Figure 3:
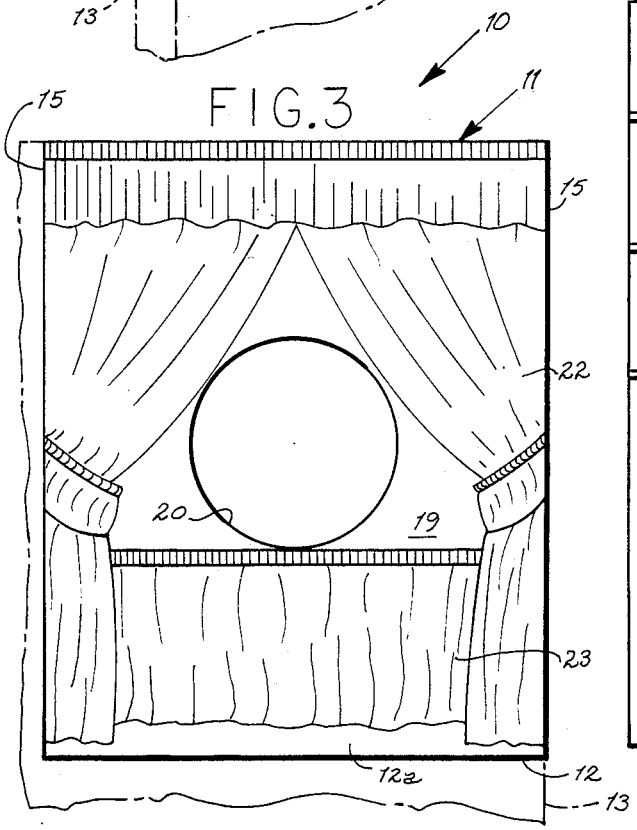
FIG. 3 is a rear view of FIG. 1.

Accordingly, a divider 10 is shown to include a rectangular frame 11, fabricated of wood or plastic material, having a pair of spaced lip portions 12 integrally attached to the horizontal bottom portion 12*a*. Lip portions 12 serve to engage with the sides of wall 13, when the top portion of wall 13 is received within the opening 14 defined by lip portions 12, and 12 provides a snug fit of frame 10 to the wall 13, but enables the owner to remove frame 11 without having to remove any fasteners, because none are used, so as not to deface the wall 13, when one desires to remove frame 10 therefrom. One of the vertical sides 15 is designed to engage with the stub portion 16 of the wall 13, and the opposite side 15 is received flush with the extending end of wall 13, as is the top portion 11*a* with the stub portion 16. A pair of spaced shelves 17 include a cut-out 18 on each end, which is fitted to sides 15, and fixedly secured thereto, in a suitable manner. The longitudinal rear edges of shelves 17 are similarly secured to one side of rear wall 19, which is similarly secured to frame 11. An opening 20 is provided through wall 18, as a false window, and a pair of intermediate shelves 21, having cut-outs 18, are similarly secured to divider 10 on the sides of opening 20. Curtains 22 and 23 are suitably secured to frame 11 on one side, but do not obscure opening 20.

In use, divider 10 is lifted, and the opening 14 is aligned with the stub portion 16. The frame 11 is then firmly urged downward, until the top of wall 13 is fully received in opening 14, and the lip portions 12 firmly render frame 11 stationary on wall 13.

Figure 4:
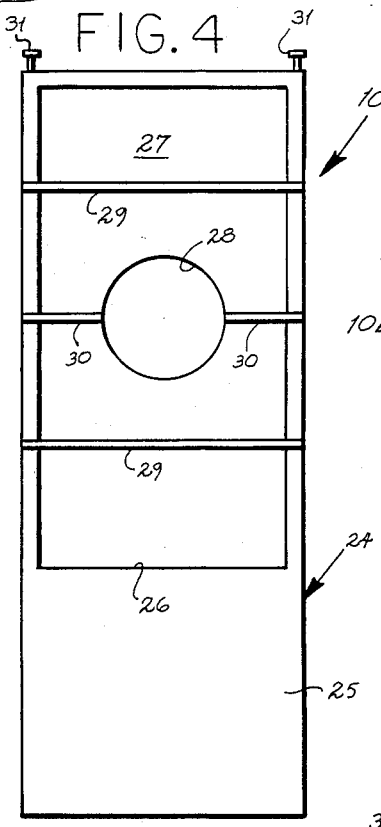
FIG. 4 is a front elevational view of a modified form of the invention.

Looking now at FIG. 4, a modified divider 10*a* is shown to include a rectangular frame 24, having a base portion 25, which is designed to rest upon the floor (not shown). A rectangular opening 26 is defined through frame 24, and a rear wall 27 is fixedly secured within opening 26. Frame 24 also includes an opening 28, which serves as a false window, and shelves 29 and 30 are provided, and are similar to the shelves 17 and 21, heretofore described of frame 11 of divider 10. A pair of spaced and adjustable height posts 31 are suitably fixedly secured to the top of frame 24, so as to render divider 10*a* stationary.

In use, divider 10*a* functions in the same manner as described of divider 10, with the exception, that it is designed as a floor-to-ceiling conception, for use where no half divider exists, and the posts 31 are spring-loaded for automatic adjustment.

Figure 5:
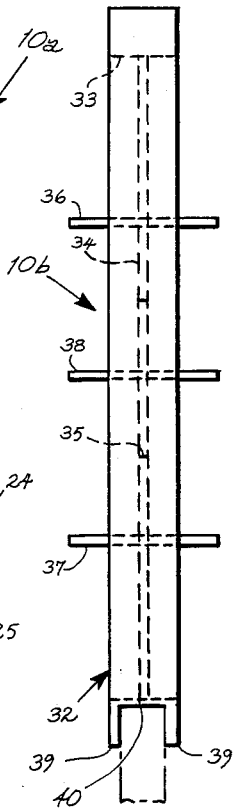
FIG. 5 is a side elevational view, showing another modified form of the invention.

Looking now at FIG. 5, another modified form of divider 10*b* is shown to include a frame 32 of rectangular configuration, having a similar-shaped opening 33 therein. A center wall 34 is provided, and is suitably secured within opening 33, and includes an opening 35 as a false window therethrough. Spaced shelves 36, 37, and 38 are also provided, but extend from both the front and back of divider 10*b*, as in contrast with the embodiments heretofore described. A pair of lip portions 39, defining an opening 40 on the bottom of divider 10*b*, are similar to 12 and 14 described of 10, for receiving wall 13, and retaining divider 10 thereto.

In use, divider 10*b* functions in the same manner as described of divider 10, with the exception, that the shelves 36, 37, and 38 extend from both sides of a center wall 34, enabling articles to be placed on one or both sides of divider 10*b*.

While various changes may be made in the detail construction, it is understood that such changes will be within the spirit and scope of the present invention, as is defined by the appended claims.

What I claim is:

1. A hutch divider, comprising, in combination, a rectangular frame, a pair of spaced apart, longitudinally extending lip portions integrally attached to a horizontal bottom end of said frame, a central opening formed by said frame, a wall inside said opening being in a parallel plane to front and rear sides of said frame and being located centrally therebetween, a plurality of spaced apart shelves extending from both a front and rear of said divider, and a relatively smaller opening through said central wall serving as a false window; and said lip portions removably engaging with an existing divider wall.

* * * * *